US005103525A

United States Patent [19]

Nakayama

[11] Patent Number: 5,103,525

[45] Date of Patent: Apr. 14, 1992

[54] APPARATUS FOR REMOVING A RESIDUAL LAP OF A SPOOL

[75] Inventor: Hiroshi Nakayama, Kanazawa, Japan

[73] Assignee: Kabushiki Kaisha Murao and Company, Kanazawa, Japan

[21] Appl. No.: 639,886

[22] Filed: Jan. 11, 1991

[51] Int. Cl.[5] ..... A46B 13/02; A46B 17/06

[52] U.S. Cl. ..... 15/88.3; 15/4; 15/38; 15/88.4; 15/306.1; 15/308

[58] Field of Search ..... 15/3, 4, 88.3, 88.4, 15/88, 302, 308, 38; 28/296

[56] References Cited

U.S. PATENT DOCUMENTS

| | | | |
|---|---|---|---|
| 1,119,993 | 12/1914 | Sharples et al. | 28/296 |
| 1,274,522 | 8/1918 | Dronsfield | 15/88.3 |
| 2,277,657 | 3/1942 | Pinnelli | 15/88.3 |
| 2,385,039 | 9/1945 | Steinmetz | 15/88.3 |
| 2,701,376 | 2/1955 | Smith | 15/4 |
| 2,710,440 | 6/1955 | Bauer | 28/296 |
| 2,785,423 | 3/1957 | Martin | 15/88.3 |
| 3,928,884 | 12/1975 | Sutter | 15/88.3 |
| 4,461,050 | 7/1984 | Gantz et al. | 15/3 |

*Primary Examiner*—Edward L. Roberts

*Attorney, Agent, or Firm*—Oblon, Spivak, McClelland, Maier & Neustadt

[57] ABSTRACT

The present invention provides an apparatus which employs a mechanical removal system in place of a conventional air jet system, in removing a residual lap on a spool. The residual lap removal apparatus according to the present invention principally comprises a bobbin holder, a rotational brush and a spike roller, wherein the spool on a conveyor is carried to a rotating position of the rotational brush by the bobbin holder, the residual lap on the spool is mechanically removed by the brush, and the lap on the rotational brush is transferred to spike pins on the spike roller whereby the removal processing of the residual lap can be positively carried out.

9 Claims, 4 Drawing Sheets

APPARATUS FOR REMOVING A RESIDUAL LAP OF A SPOOL

FIELD OF THE INVENTION

This invention relates to an apparatus for removing a residual lap of a spool, which, in a spinning mill, efficiently removes a residual lap from a spool for winding a ribbon lap and a sliver lap (hereinafter merely generally called a lap).

BACKGROUND OF THE INVENTION

In a spinning mill, raw cotton is first opened by a mixing and blowing apparatus to remove impurities and form a sheet-like lap. Ordinarily, in the final step, a so-called lap machine is used, and the produced lap is wound on a large-diameter bobbin called a spool and to convey it to the succeeding step.

Also in the combing step subsequent to the mixing and blowing step, a sliver lap machine or a ribbon lap machine is used to make a sliver lap or a ribbon lap, which are also wound on a spool and conveyed.

The spool used in these various steps is reciprocatingly moved between the steps for repetitive use, and therefore, in order that it is attached to the lap machine or the like to wind a new lap, it is necessary, as the preparing step, to completely remove a residual lap remaining on the surface of the spool. As apparatus for carrying out such a lap removal work, for example, apparatus comprising a combination of a draft mechanism and an air nozzle has been known (see Japanese Patent Publication No. 54-22528 (1979) official gazette).

According to the aforesaid patent, an unprocessed spool with a residual lap is held on a draft mechanism comprising a pair of parallel rollers and rotated in a direction of unwinding a residual lap and at the same time, an air jet from an air nozzle is jetted in a tangential direction of the spool to effect pick-finding and unwinding of the residual lap.

According to the prior art as just mentioned, the pick finding of the residual lap on the spool exclusively relies upon the air jet. It is therefore necessary for realizing the positive pick finding that the direction of the air jet be accurately registered with the tangential direction of the lap at the extreme end of the residual lap (more accurately, the tangential direction of the surface of the extreme end of the lap of the uppermost layer at the contact portion between said extreme end and the next lap). However, since the amount of the residual lap on the spool is not always constant, it is difficult to always fulfill the aforesaid condition. Thus the prior art unavoidably posing a problem that the pick finding is imperfect, sometimes resulting in a failure of lap removing work.

OBJECTS OF THE INVENTION

In view of the prior art as described above, it is an object of this invention to provide a new apparatus for removing a residual lap of a spool in which in place of an air jet from an air nozzle, a rotational brush which mechanically contacts a residual lap on the spool is used to mechanically tear off the residual lap whereby removing processing of the residual lap can be positively carried out.

BRIEF SUMMARY OF THE INVENTION

For achieving the aforesaid object, apparatus of the present invention principally comprises a bobbin holder comprising a holder for holding a spool and a motor which positively rotates the spool held by the holder in a unwinding direction of a residual lap, a rotational brush which rotates in contact with the spool held by the bobbin holder to remove the residual lap on the spool, and a spike roller with spike pins spirally mounted on a drum and which rotates in contact with the rotational brush.

It is to be noted that the bobbin holder may be reciprocated and oscillated between a preparation position at which a spool is mounted and removed and an operating position at which a residual lap of the held spool is removed, and the rotational brush may be changed in its rotational speed.

Furthermore, in the spike roller, a spike pin base with its side end formed into an oblique side may be added to the spike pin.

According to the above-described arrangement, in the bobbin holder, the spool with a residual lap is held by the holder and can be positively rotated in the unwinding direction of the residual lap. Therefore, the rotational brush can be rotated at a speed higher than that of the spool to thereby continuously remove the residual lap to be unwound in order from the extreme end portion thereof so as to be torn off. On the other hand, the spike roller is moved onto the rotational brush to scrap the residual lap as fiber waste, which can be continuously opened and discharged.

If the bobbin holder can be reciprocated and oscillated between the preparatory position and the operating position, for example, the preparatory position is determined on the conveyor for the spool whereby the entire apparatus can be easily incorporated into the conveyor line of the spool.

If the rotational speed of the rotational brush is made variable, the rotational brush can be rotated at a higher speed at the time when the residual lap has been completely removed to thereby more completely remove the fiber waste adherred to the surface of the spool.

Moreover, if the spike pin base is added to the spike roller, a flow of air from the base of the spike pin toward the extreme end is generated by rotation of the spike roller whereby the fiber waste on the spike pins can be smoothly separated.

BRIEF DESCRIPTION OF THE DRAWINGS

FIGS. 1 through 4 show embodiments in which:

FIG. 1 is a perspective explanatory view of the structure of essential parts, FIG. 2 is an explanatory view of the whole structure, FIG. 3 is a plan view of essential parts, and FIG. 4 is an enlarged perspective view of essential parts. The following letters and numerals refer to the associated parts in the drawings:

Figure 1:
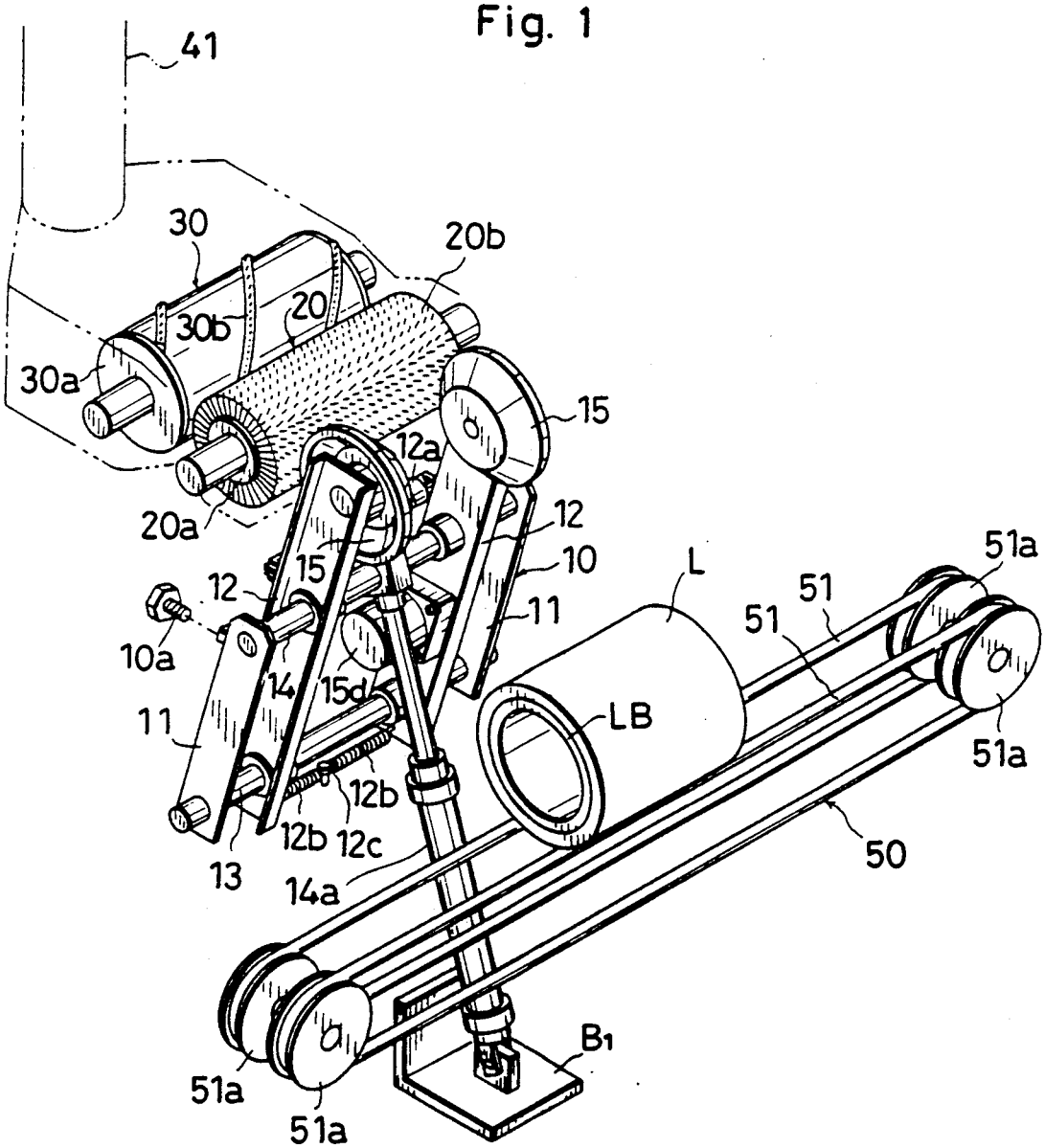

L . . . residual lap, LB . . . spool, 10 . . . bobbin holder, 15 . . . holder, **15*d* . . . motor, 20 . . . rotational brush, 30 . . . spike roller, 30*a* . . . drum, 30*b* . . . spike pin base, 30*c*** . . . spike pin.

DETAILED DESCRIPTION OF THE INVENTION

Embodiments of the present invention will be described hereinafter.

An apparatus for removing a residual lap of a spool principally comprises a bobbin holder 10, a rotational brush 20 and a spike roller 30 (FIGS. 1 and 2), which are assembled on a base frame B as a whole.

The bobbin holder 10 comprises a pair of oscillating arms 11, 11 and a pair of slide arms 12, 12 (FIGS. 1 and 3), the oscillating arms 11, 11 having their base secured to a shaft 13 whereas the extreme end thereof is connected by a further shaft 14. The shaft 13 is rotatably supported through bearings 13*a* and 13*a* while the slide arms 12 and 12 are slidably fitted with respect to the shafts 13 and 14.

The slide arms 12 and 12 are connected at their intermediate portions through an air cylinder 12*a*, and base ends of the slide arms 12 and 12 are connected to fixed pins 12*c*, respectively, by tension springs 12*b* and 12*b*. Stoppers 13*b*, 13*b* . . . for defining the sliding limit of the slide arms 12 and 12 are mounted on the shaft 13.

Cap-shaped holders 15 and 15 are rotatably mounted on the extreme ends of the slide arms 12 and 12. One holder 15 is connected to a motor 15*d* secured to an intermediate portion of the slide arm 12 through a sprocket 15*a*, a chain 15*b* and a sprocket 15*c*.

Figure 2:
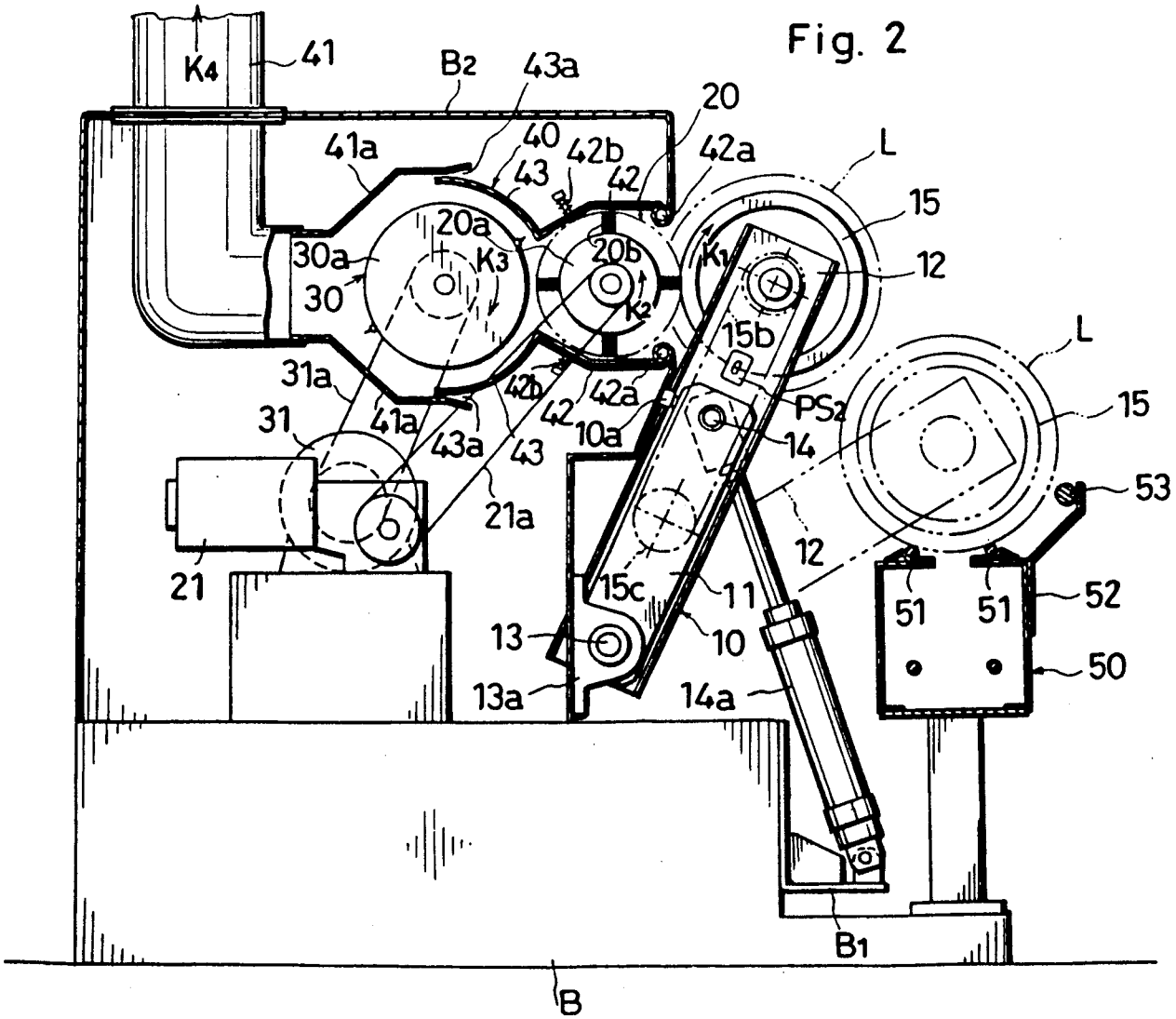

A rod of an air cylinder 14*a* is connected to an intermediate portion of the shaft 14, and an base end of the air cylinder 14*a* is connected to the base frame B through a bracket B1 (FIGS. 1 and 2). A stopper bolt 10*a* for determining an operating position of the bobbin holder 10 when the air cylinder 14*a* is extended is disposed at the rear of one oscillating arm 11.

Figure 3:
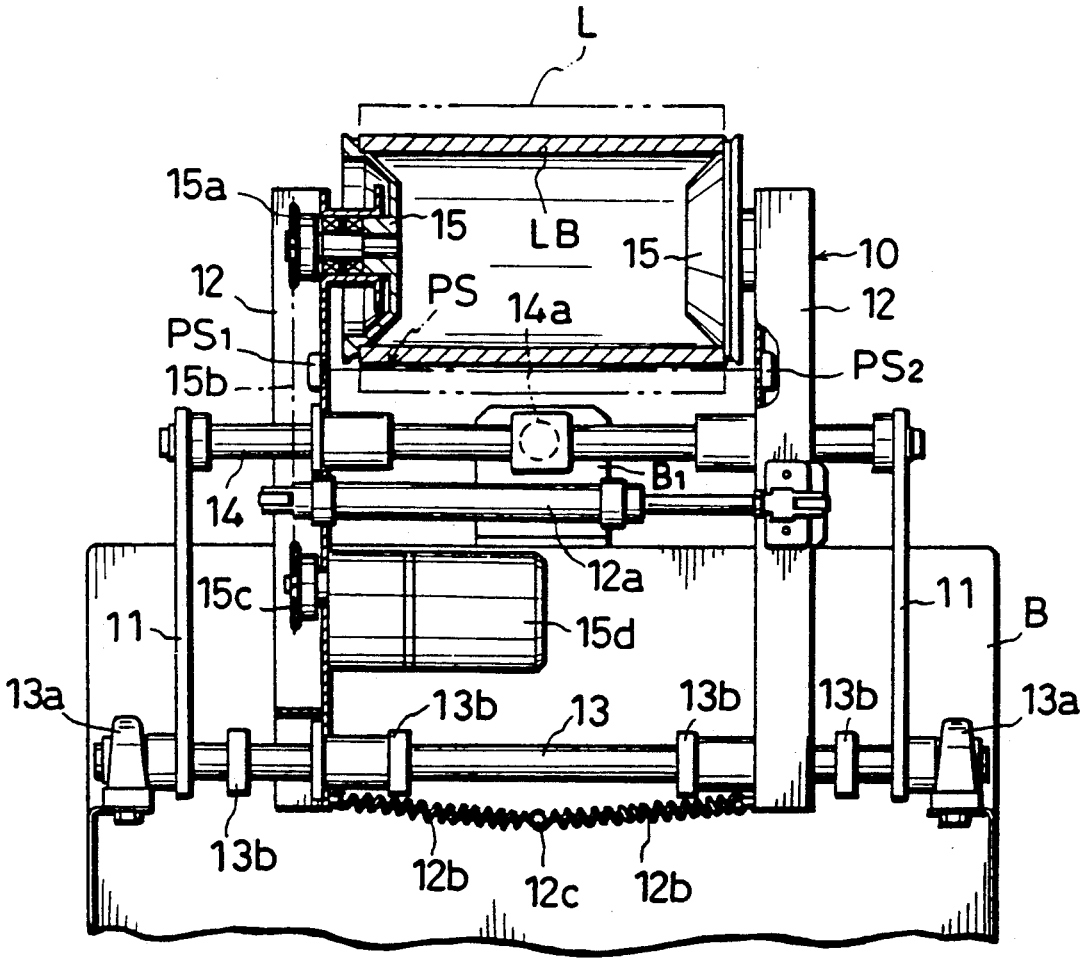

A sensor PS comprising a projector PS1 and a light receiver PS2 is mounted on the slide arms 12 and 12 (FIG. 3). The sensor PS can sense the presence or absence of a residual lap L on the spool LB held by the holders 15 and 15.

The rotational brush 20 is disposed at the rear of the bobbin holder 10 (FIGS. 1 and 2). When the bobbin holder 10 is at the operating position, the rotational brush 20 rotates in contact with the spool LB held by the bobbin holder 10, and has hard brush hair 20*b* in the periphery of a brush drum 20*a*. The axial end of the rotational brush 20 is connected to a variable speed motor 21 through a belt 21*a*.

Figure 4:
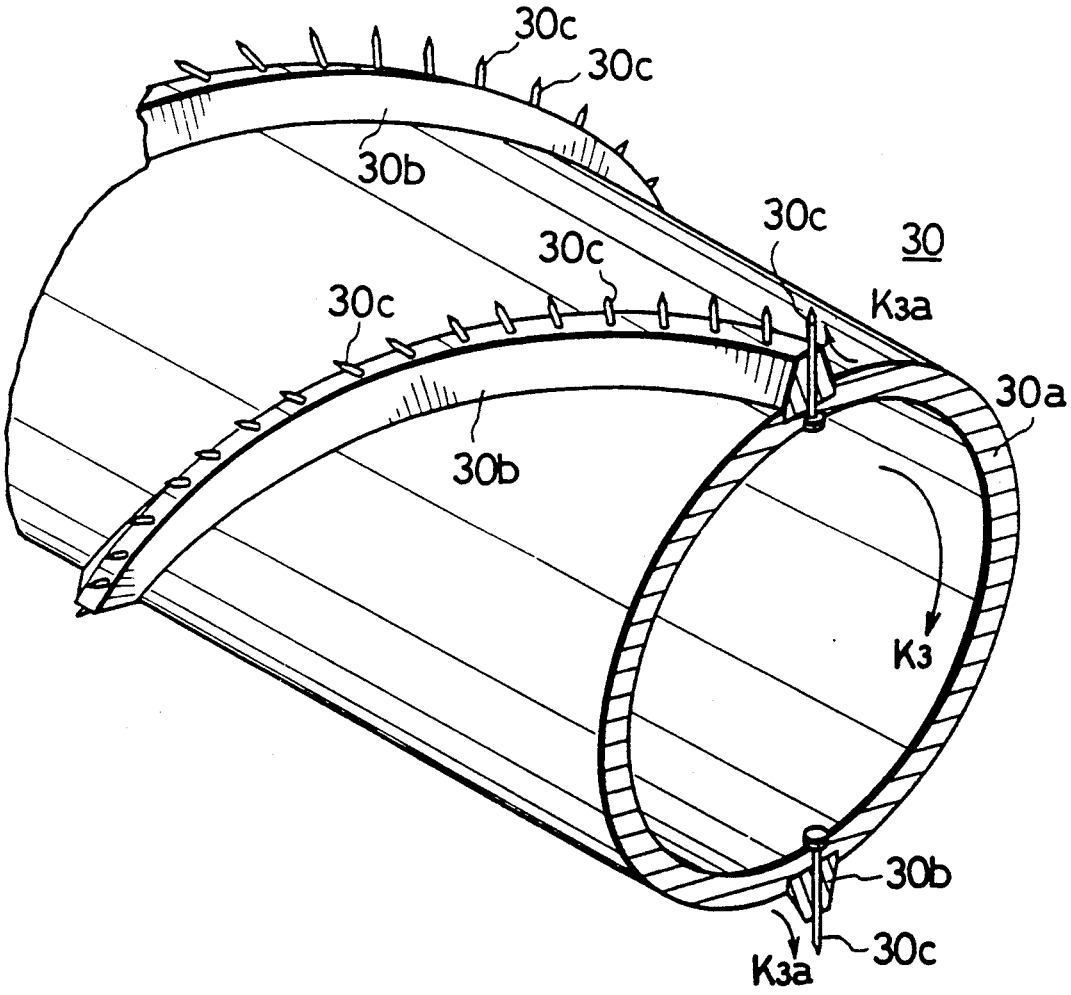

The spike roller 30 is disposed at the rear of the rotational brush 20, and is connected to a further motor 31 through a belt 31*a*. The spike roller 30 has a number of spike pins 30*c*, 30*c* . . . spirally provided in the periphery of a drum 30*a* through a spike pin base 30*b* having a substantially trapezoidal shape (FIG. 4). Here, not only one but more than two spike pin bases 30*b* may be used. The spike roller 30 rotates in contact with the rotational brush 20 (FIG. 20), and the former, spike pins 30*c*, 30*c* . . . are operated so as to successively comb the surface portion of the latter, brush hair 20*b*.

The rotational brush 20 and the spike roller 30 have their front side opened toward the bobbin holder 10, and the rear side received into a cover duct 40 connected to a cotton collector with a suction blower not shown through an air duct 41. The cover duct 40 comprises vertically closeable movable covers 42 and 42 above and below the rotational brush 20, the movable covers 42 and 42 being pivoted to fixed pins 42*a* and 42*a* at the front end of the cover duct 40 and being biased in a closing direction by compression springs 42*b* and 42*b*.

The front half portion of the spike roller 30 is covered by fixed covers 43 and 43, an the latter half portion thereof is covered by cover places 41*a* and 41*a* attached to the air duct 41. Joined portions between the fixed covers 43, 43 and the cover plates 41*a*, 41*a* are formed with slit-like air intake holes 43*a*, 43*a* opened forwardly. The cover duct 40 as a whole is assembled in a cover frame B2 on the base frame B.

Forwardly of the bobbin holder 10 is disposed a conveyor 50 having two endless conveyor belts 51 and 51 (FIGS. 1 and 2). The conveyor belts 51 and 51 are passed over pulleys 51*a*, 51*a* . . . and travel along a box-like conveyor guide 52, so that a spool LB with a residual lap L supplied from one end thereof passes frontwardly of the bobbin holder 10 and can be conveyed to the other side. The conveyor 50 is provided with a guide rod 53 to prevent the spool LB from being fallen.

Now, the spool LB with a residual lap L supplied from one end side of the conveyor 50 is introduced into a defined position in front of the bobbin holder 10 (FIG. 1). At this time, the bobbin holder 10 stands-by with the air cylinder 12*a* extended whereby the mutual spacing between the slide arms 12, 12 and the holders 15, 15 is sufficiently opened, and the air cylinder 14*a* is extended to be erected upwardly highly.

When the spool LB is introduced into the defined position, the air cylinder 14*a* is contracted. Thereby, the bobbin holder 10 as a whole can assume its preparatory position while being oscillated downwardly about the shaft 13 (as indicated at the dash-dotted contour lines in FIG. 2). At this time, the holders 15, 15 of the bobbin holder 10 are positioned so as to sandwich the spool LB on the conveyor 50 between both front and rear sides thereof, and the length of the slide arms 12, 12 of the bobbin holder 10, the position of arrangement of the conveyor 50 and the like are determined so as to assume substantially the same center position as that of the bobbin holder 10.

Then, when the air cylinder 12*a* is contracted, the holders 15 and 15 comes closer from the front and rear of the spool LB to hold it therebetween (FIG. 3). Since the holders 15 and 15 are formed into a cap-shape, the tops thereof can be smoothly moved into openings at both ends of the spool LB. Further, the slide arms 12 and 12 are biased in a direction of being pulled each other by means of the tension springs 12*b* and 12*b* and can be stopped at suitable positions on the shafts 13 and 14. Therefore, even if the stop position of the spool LB on the conveyor 50 should be somewhat irregular, the holders 15 and 15 can positively hold it from the front and rear sides thereof.

When the air cylinder 14*a* is then extended, the bobbin holder 10 can be stood upright at its operating position while holding the spool LB (as indicated by the solid line in FIG. 2). When the motor 15*d* is started, the spool LB held by the holders 15 and 15 can be positively rotated in a predetermined direction, and at the same time, when the motor 21 is started, the residual lap L on the spool LB can be continuously removed by the rotational brush 20. The rotating direction of the spool LB caused by the motor 15*d* is the direction of unwinding the residual lap L (for example, the direction as indicated at arrow K1 in FIG. 2), and the rotating direction of the rotational brush 20 is determined to be reversed to the former (the direction as indicated at arrow K2 in FIG. 2). At this time, the rotational speed of the rotational brush 20 is preferably made to be somewhat higher than that of the spool LB, whereby the residual lap L can be continuously transferred onto the rotational brush 20 in a manner of being successively torn from the extreme end thereof.

The motor 31 for rotating the spike roller 30 is started simultaneously with the motor 21 for driving the rotational brush 20. The rotating direction of the spike roller 30 is reversed to that of the rotational brush 20 (the direction indicated at arrow K3 in FIG. 2), and the rotational speed is made to be higher than that of the rotational brush 20. The residual lap L transferred onto the rotational brush 20 as the fiber waste is continuously scraped by the spike pins 30*c*, 30*c*, . . . of the spike roller 30 and opened, after which they are separated from the spike pins 30*c*, 30*c* . . . by the air flow flowing into the air duct 41 and discharged in a direction as indicated at arrow K4 in FIG. 2).

The air flow within the air duct 41 is generated by air from a lower one out of air intake holes 43*a* and 43*a* formed at upper and lower portions of the spike roller 30. Since the upper hole is opened reversely to the rotating direction of the spike roller 30, it hardly intakes air. Since the spike pins 30*c*, 30*c* . . . of the spike roller 30 are mounted through the spike pin base 30*b*, a local air flow (indicated at arrows K3*a* and K3*a* in FIG. 4) from the base portion to the extreme end is generated in the vicinity of the spike pins 30*c*, 30*c* . . . by rotation of the spike roller 30. Accordingly, fiber waste scraped out of the rotational brush 20 by the spike pins 30*c*, 30*c* . . . can be smoothly separated from the spike pins 30*c*, 30*c* . . . and discharged to the air duct 41.

Normally, the residual lap L to be removed from the spool LB by the rotational brush 20 is transferred little by little determined by the rotating speed of the spool LB onto the rotational brush 20 but sometimes a piece of lumpy fiber waste is transferred onto the rotational brush 20. At this time, the upper and lower opening and closing covers 42 and 42 of the rotational brush 20 are temporarily opened up and down to form a wide passage for transporting the lumpy fiber waste toward the spike roller 30, and therefore, the fiber waste will not be lodged in the upper and lower portions of the rotational brush 20.

When all the residual lap L is removed from the spool LB, the sensor PS is activated, and the rotational speed of the rotational brush 20 is temporarily increased in speed in response thereto. Thereby downy fiber waste adherred to the surface of the spool LB can be removed to terminate the removal processing of the residual lap L.

Upon termination of the removal processing of the residual lap L, the motors 15*d*, 21 and 31 are stopped and the air cylinder 14*a* is contracted to return the bobbin holder 10 to its preparatory position. Next, when the air cylinder 12*a* is extended to open the spacing between the holders 15 and 15, the processed spool LB can be returned onto the conveyor 50. So, the bobbin holder 10 is withdrawn upwardly by the air cylinder 14*a*, and the conveyor 50 is operated to discharge the processed spool LB and an unprocessed spool LB is conveyed frontwardly of the bobbin holder 10. Thereafter, the similar procedure may be repeated.

In the foregoing, when the winding direction of the residual lap L on the spool LB is reversed, the unwinding direction is also reversed. Accordingly, at this time, it is needless to say that the respective rotating directions of the spool LB, the rotational brush 20 and the spike roller 30, respectively, caused by the motors 15*d*, 21 and 31 may be reversed to the directions indicated at K1, K2 and K3 in FIG. 2.

When the unwinding direction of the residual lap L on the spool LB to be processed is locked to one direction, one out of the upper and lower air intake holes 43*a* and 43*a* of the spike roller 30 will suffice to be provided, which intake opening hole is located on the side for effectively intaking air while being adjusted to the rotating direction of the spike roller 30. The spike pin base 30*b* may be of the configuration wherein a side end on the front side in the rotating direction of the spike roller 30 which rotates in one direction is formed into an oblique side to generate an air flow from the base of the spike pins 30*c*, 30*c* . . . toward the extreme end, and a substantial trapezoid in section need not always be provided. For example, the spike pin base 30*b* having a substantial triangle in section may be merely provided on one side of the spike pins 30*c*, 30*c* . . to obtain a function substantially equal thereto.

It is to be noted that the conveyor 50 can be selected suitably in its type and conveying direction other than those of the previous embodiments as long as the spool LB can be conveyed and further mounted and removed by the bobbin holder 10.

As described above, according to the present invention, the rotational brush and the spike roller are provided so that the residual lap on the spool is removed by tearing it from the extreme end thereof by the former and the fiber waste transferred onto the rotational brush is opened by the latter and discharged. Therefore, there can be obtained the excellent effects that in the removal processing of the residual lap, no failure of pick finding occurs and extremely positive removal operation can be realized.

Furthermore, the spool held by the bobbin holder and being subjected to removal processing is positively rotated in a direction of unwinding the residual lap, and the quantity of the fiber waste removed by the rotational brush can be always maintained in a proper quantity determined by the rotating speed of the spool. Therefore, there can be also obtained the excellent effect of the least occurrence that the function of removing the residual lap by the rotational brush is unexpectedly lowered to lose the whole function.

WHAT IS CLAIMED IS

1. An apparatus for removing a residual lap of a spool comprising a bobbin holder comprising a holder for holding a spool and a motor for positively rotating the spool held by said holder in a direction of unwinding a residual lap, a rotational brush which rotates in contact with the spool held by the bobbin holder to remove the residual lap on the spool, and a spike roller with spike pins spirally mounted on a drum and which rotates in contact with said rotational brush.

2. An apparatus for removing a residual lap of a spool according to claim 1, wherein said bobbin holder can be reciprocated and oscillated between a preparatory position for mounting and removing the spool and an operating position for removing the residual lap of the held spool.

3. An apparatus for removing a residual lap of a spool according to claim 2, wherein said bobbin holder comprises a pair of oscillating arms having a lower end rotatably supported, a shaft is extended between said oscillating arms, and an air cylinder is disposed between said shaft and a base so that said bobbin holder can be reciprocated and oscillated.

4. An apparatus for removing a residual lap of a spool according to claim 1, wherein said bobbin holder comprises a pair of slide arms, at least one of which is slidable in a direction parallel with the axis of the spool to be supplied, each of said slide arms having one of a pair of holders for holding the spool rotatably mounted at the extreme end thereof so as to mount and remove said spool.

5. An apparatus for removing a residual lap of a spool according to claim 4, wherein said pair of holders have their opposed surface formed into a convex shape so that the former can be fitted in openings at opposite ends of the spool, said pair of slide arms are connected through an expansion cylinder, and an approach is made from opposite or one side of the spool by said expansion cylinder to fit a part of each of said pair of holders into openings on opposite ends of the spool whereby the spool is mounted and removed.

6. An apparatus for removing a residual lap of a spool according to claim 1, wherein the rotational speed of said rotational brush is variable.

7. An apparatus for removing a residual lap of a spool according to claim 1, wherein said spike roller has a spike pin base having a side end formed into an oblique side added to spike pins.

8. An apparatus for removing a residual lap of a spool according to claim 1, wherein said rotational brush and said spike roller are driven reversely, and the rotating speed of said spike roller is set to be higher than that of said rotational brush.

9. An apparatus for removing a residual lap of a spool according to claim 8, wherein said rotational brush and said spike roller are disposed within an air intake cover having an air intake formed in a part thereof for taking in air from the vicinity of the rotational brush and said spike roller.

* * * * *